US009334751B2

(12) United States Patent
Dube et al.

(10) Patent No.: US 9,334,751 B2
(45) Date of Patent: May 10, 2016

(54) VARIABLE VANE INNER PLATFORM DAMPING

(75) Inventors: David P. Dube, Saco, ME (US); Richard K. Hayford, Cape Neddick, ME (US)

(73) Assignee: United Technologies Corporation, Hartford, CT (US)

( * ) Notice: Subject to any disclaimer, the term of this patent is extended or adjusted under 35 U.S.C. 154(b) by 972 days.

(21) Appl. No.: 13/437,988

(22) Filed: Apr. 3, 2012

(65) Prior Publication Data

US 2013/0259658 A1 Oct. 3, 2013

(51) Int. Cl.
*F01D 17/16* (2006.01)
*F01D 5/10* (2006.01)

(52) U.S. Cl.
CPC ..... *F01D 17/162* (2013.01); *F01D 5/10* (2013.01); *F05D 2260/96* (2013.01); *F05D 2300/431* (2013.01); *Y10T 29/49863* (2015.01)

(58) Field of Classification Search
CPC ..... F01D 5/00; F01D 5/10; F01D 5/16; F01D 5/26; F01D 25/04; F01D 25/06; F04D 29/66; F04D 29/668
USPC ..... 415/119, 151, 155, 156, 159, 160, 415/174.2, 191, 199.1, 199.4, 199.5, 208.1, 415/208.2, 209.2, 209.3, 209.4, 210.1; 416/190, 205, 500
See application file for complete search history.

(56) References Cited

U.S. PATENT DOCUMENTS

| | | | | |
|---|---|---|---|---|
| 4,262,889 | A * | 4/1981 | Moore | 267/140.5 |
| 4,399,974 | A * | 8/1983 | Takei | 248/605 |
| 5,411,370 | A | 5/1995 | Varsik | |
| 5,807,072 | A | 9/1998 | Payling | |
| 6,254,706 | B1 * | 7/2001 | Ozawa | 156/64 |
| 6,722,463 | B1 * | 4/2004 | Reese | 180/292 |
| 6,887,035 | B2 | 5/2005 | Bruce | |
| 6,969,239 | B2 | 11/2005 | Grant et al. | |
| 7,220,098 | B2 | 5/2007 | Bruce et al. | |
| 7,503,750 | B1 | 3/2009 | Violette | |
| 7,802,963 | B2 | 9/2010 | Holland et al. | |
| 2002/0076321 | A1 * | 6/2002 | Nicolson et al. | 415/160 |
| 2005/0008489 | A1 | 1/2005 | Perruchant et al. | |
| 2005/0079062 | A1 | 4/2005 | Surace et al. | |
| 2006/0245916 | A1 | 11/2006 | Foucher | |
| 2008/0031730 | A1 | 2/2008 | Houradou et al. | |
| 2008/0101935 | A1 * | 5/2008 | Clouse et al. | 416/193 A |
| 2008/0219832 | A1 | 9/2008 | Major et al. | |
| 2008/0253882 | A1 * | 10/2008 | Major et al. | 415/148 |
| 2009/0140476 | A1 * | 6/2009 | Michiyama et al. | 267/121 |
| 2010/0232936 | A1 * | 9/2010 | Mielke et al. | 415/160 |
| 2010/0266389 | A1 | 10/2010 | Cloarec | |
| 2011/0150643 | A1 * | 6/2011 | Wery et al. | 415/200 |
| 2011/0176913 | A1 * | 7/2011 | Wassynger et al. | 415/159 |

OTHER PUBLICATIONS

Robinson, Injection Molded Rubber, Jul. 3, 2010, as found at http://web.archive.org/web/20100703100710/http://www.robinsonrubber.com/pages/injection-molding.html.*

(Continued)

*Primary Examiner* — Dwayne J White
*Assistant Examiner* — Aaron R Eastman
(74) *Attorney, Agent, or Firm* — Carlson, Gaskey & Olds, PC

(57) ABSTRACT

A variable vane assembly includes a damper positioned between a platform and a trunnion. The damper is comprised of a resilient material.

26 Claims, 4 Drawing Sheets

(56) References Cited

OTHER PUBLICATIONS

Robinson, Molded Rubber Components-Bonded-To-Substrates, Jan. 23, 2009, as found at http://web.archive.org/web/20090123112917/http://robinsonrubber.com/pages/products_mrc_bts.html.*

International Preliminary Report on Patentability for PCT Application No. PCT/US2013/034528, mailed Oct. 16, 2014.

International Search Report and Written Opinion for International Application No. PCT/US2013/034528 completed on Jan. 7, 2014.

* cited by examiner

VARIABLE VANE INNER PLATFORM DAMPING

BACKGROUND

This disclosure relates generally to a variable vane and, more particularly, to damping vibrations of the variable vane during operation.

Turbomachines, such as gas turbine engines, typically include a fan section, a compressor section, a combustor section, and a turbine section. Air moves into the turbomachine through the fan section. Airfoil arrays in the compressor section rotate to compress the air, which is then mixed with fuel and combusted in the combustor section. The products of combustion are expanded to rotatably drive airfoil arrays in the turbine section. Rotating the airfoil arrays in the turbine section drives rotation of the fan and compressor sections.

Some turbomachines include variable vanes. Changing the positions of the variable vanes influences how flow moves through the turbomachine. Variable vanes are often used within the first few stages of the compressor section. The variable vanes are exposed to vibrations during operation of the turbomachine. The vibrations can fatigue and damage the variable vanes.

SUMMARY

In a featured embodiment, a variable vane damper has a body comprised of a resilient material. The body includes a first surface that is bondable to an inner platform of a variable vane and a second surface that is bondable to an inner diameter trunnion component.

In another embodiment according to any of the previous embodiments, the body is comprised of an elastomeric material.

In another embodiment according to any of the previous embodiments, the body is comprised of silicon rubber material.

In another embodiment according to any of the previous embodiments, the body comprises a solid disc-shaped member.

In another featured embodiment, a variable vane assembly has a variable vane body, a platform formed at one end of the variable vane body, a damper bonded to the platform, and a trunnion bonded to the damper.

In another embodiment according to any of the previous embodiments, the variable vane body has a radially inner end and a radially outer end relative to a central axis of a turbomachine. The platform is formed at the radially inner end of the variable vane body.

In another embodiment according to any of the previous embodiments, the damper includes a radially outer surface that is bonded to the platform and a radially inner surface that is bonded to the trunnion.

In another embodiment according to any of the previous embodiments, the variable vane is positioned within a compression section of a geared turbine engine.

In another embodiment according to any of the previous embodiments, the trunnion, the platform, and the damper rotate together with the variable vane body.

In another embodiment according to any of the previous embodiments, the damper is comprised of a resilient material.

In another embodiment according to any of the previous embodiments, the variable vane body is comprised of a metallic material.

In another embodiment according to any of the previous embodiments, the trunnion is comprised of a metallic material.

In another embodiment according to any of the previous embodiments, the trunnion is comprised of a plastic material.

In another featured embodiment, a method of assembling a variable vane assembly includes positioning a variable vane body in a first fixture, the variable vane body including a platform at a radially inner end. A trunnion is positioned in a second fixture. A damper is placed between the trunnion and platform, the damper being comprised of an elastomeric material. The first and second fixtures are squeezed together. The elastomeric material is cured to bond the damper to the platform and the trunnion.

In another embodiment according to any of the previous embodiments, a liquid elastomeric material is injected between the platform and the trunnion.

In another embodiment according to any of the previous embodiments, a pre-molded disc is positioned between the platform and the trunnion.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
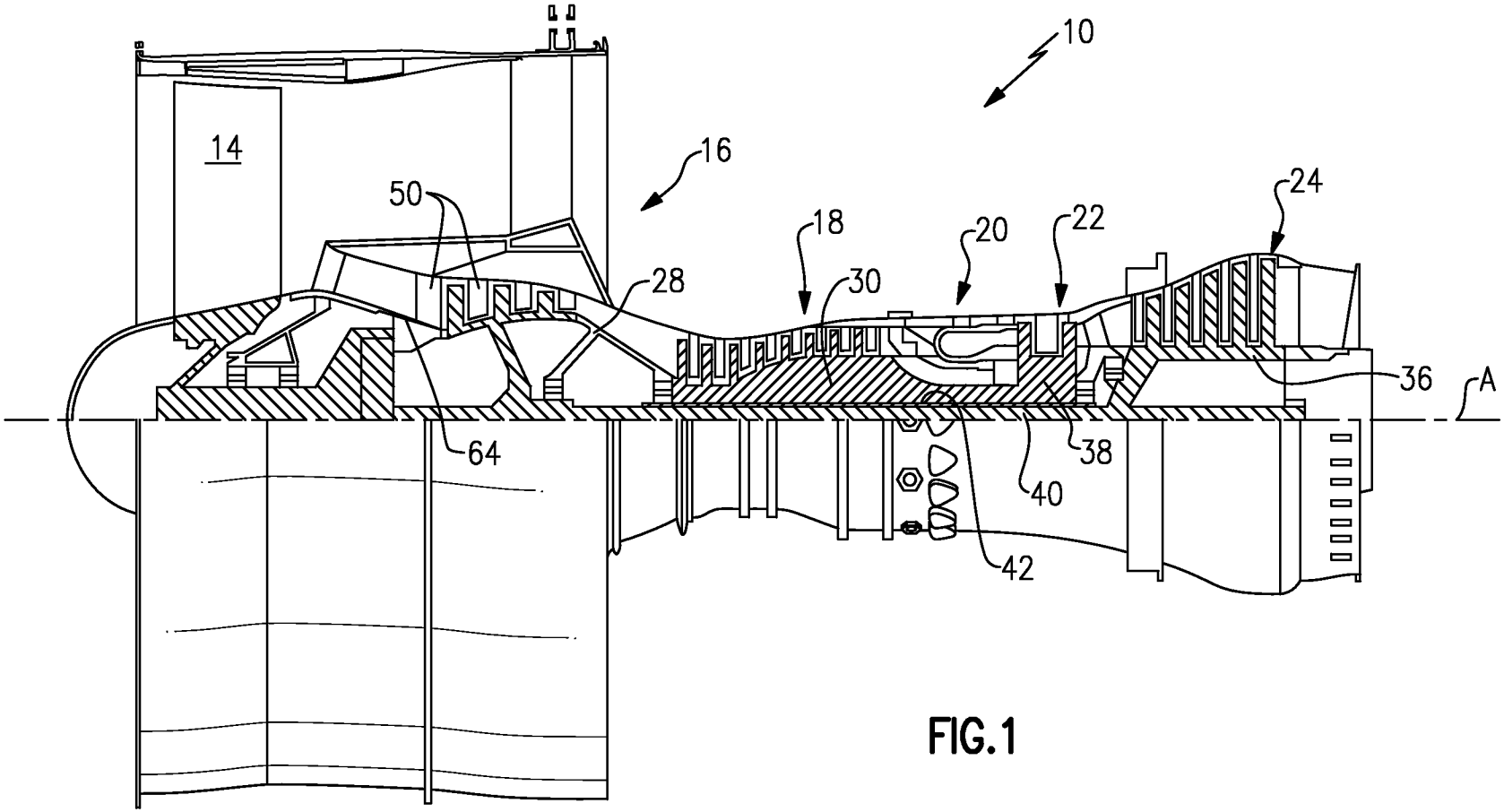
FIG. 1 shows a highly schematic view of an example gas turbine engine.
Figure 2:
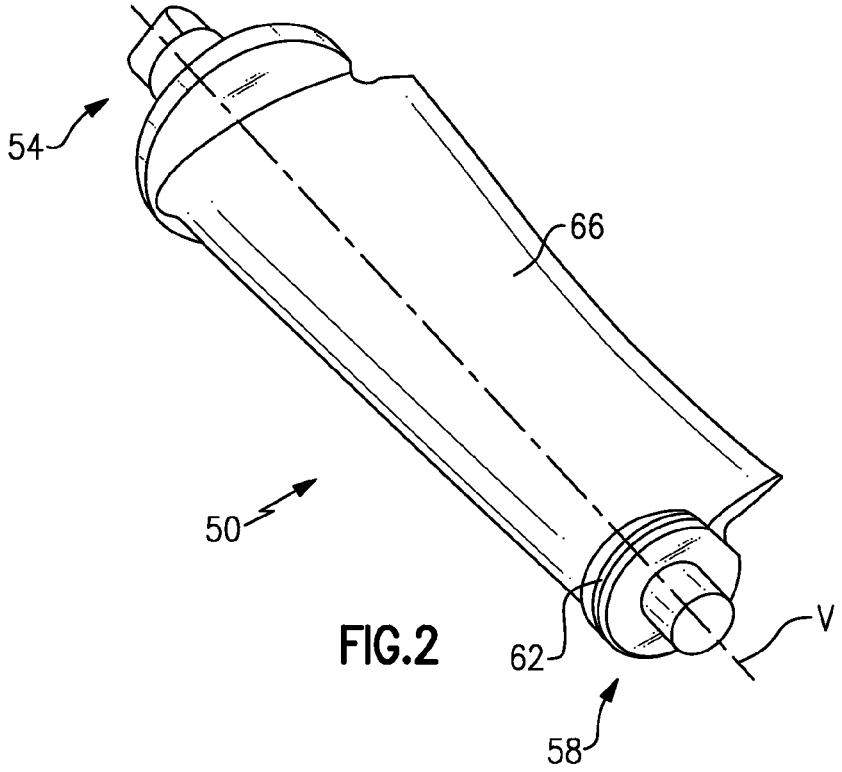
FIG. 2 shows a perspective view of an example variable vane assembly.
Figure 3:
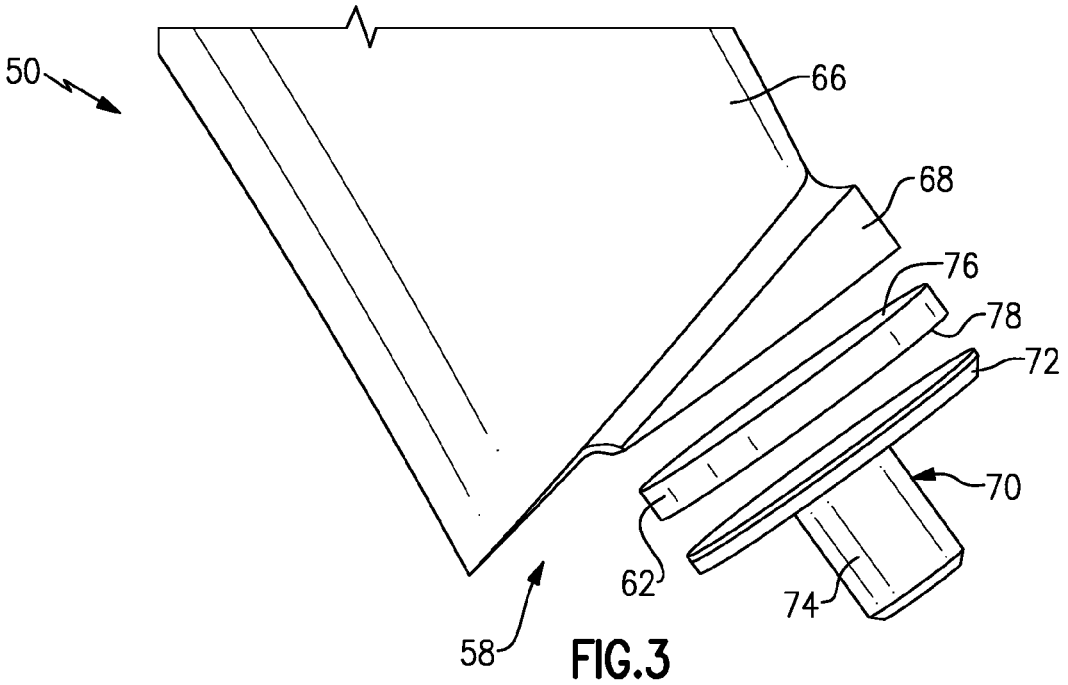
FIG. 3 shows an exploded view of a radially inner end of the FIG. 2 assembly.
Figure 4A:
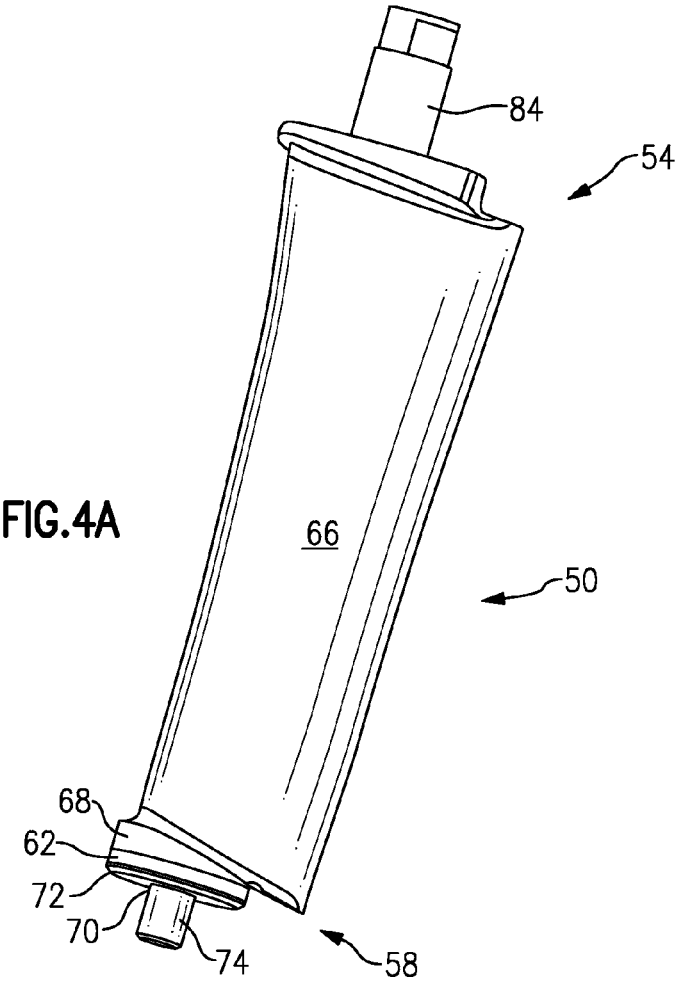
FIG. 4A shows a side view of the variable vane assembly.
Figure 4B:
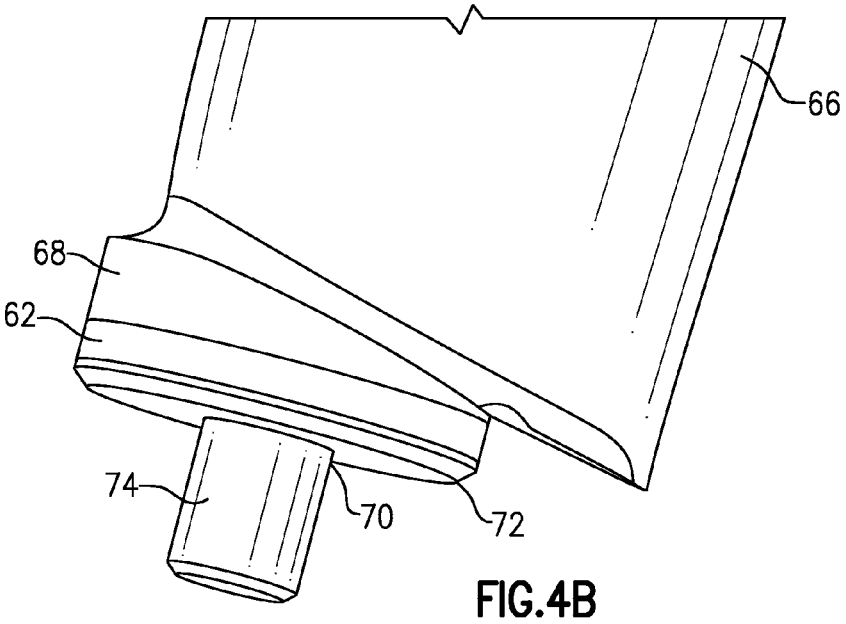
FIG. 4B is a magnified view of the radially inner end.

Referring to FIG. 1, an example turbomachine, such as a gas turbine engine 10, is circumferentially disposed about an axis A. The gas turbine engine 10 includes a fan 14, a low-pressure compressor section 16, a high-pressure compressor section 18, a combustion section 20, a high-pressure turbine section 22, and a low-pressure turbine section 24. Other example turbomachines may include more or fewer sections.

The engine 10 in the disclosed embodiment is a high-bypass geared architecture aircraft engine. In one disclosed embodiment, the bypass ratio of the engine 10 is greater than 10:1, the diameter of the fan 14 is significantly larger than that of the low-pressure compressor 16, and the low-pressure turbine section 24 has a pressure ratio that is greater than 5:1.

It should be understood, however, that the above parameters are only exemplary of one embodiment of a geared architecture engine and that the present application is applicable to other gas turbine engines including direct drive turbofans.

During operation, air is compressed in the low-pressure compressor section 16 and the high-pressure compressor section 18. The compressed air is then mixed with fuel and burned in the combustion section 20. The products of combustion are expanded across the high-pressure turbine section 22 and the low-pressure turbine section 24.

The low-pressure compressor section 16 and the high-pressure compressor section 18 include rotors 28 and 30, respectively. The high-pressure turbine section 22 and the low-pressure turbine section 24 include rotors 36 and 38, respectively. The rotors 36 and 38 rotate in response to the expansion to rotatably drive rotors 28 and 30. The rotor 36 is coupled to the rotor 28 with a spool 40, and the rotor 38 is coupled to the rotor 30 with a spool 42.

The examples described in this disclosure are not limited to the two-spool gas turbine architecture described, however, and may be used in other architectures, such as the single-spool axial design, a three-spool axial design, and still other architectures. That is,there are various types of gas turbine engines, and other turbomachines, that can benefit from the examples disclosed herein.

Referring to FIGS. 2-5 with continued reference to FIG. 1, in this example, the first few stages of low-pressure compressor section 16 include variable vane assemblies 50. The variable vane assemblies 50 extend from a radially outer end 54 to a radially inner end 58 relative to the axis A. The ends 54, 58 of the vane assemblies 50 are pivotally mounted such that each vane rotates about its own vane axis V to vary an amount of airflow through the compressor. The example variable vane assemblies 50 do not rotate about the axis A.

In this example, the radially inner end 58 of the variable vane assembly 50 includes a damper 62. The radially inner end 58 is received within a socket formed in an inner shroud 64 (FIG. 1) of the low-pressure compressor 16. The variable vane damping assembly 62 facilitates vibration absorption, which helps protect the variable vane assembly 50 from damage during operation of the gas turbine engine 10.

In this example, the variable vane assembly 50 comprises a variable vane body 66 having a platform 68 formed at the radially inner end 58 of the variable vane body 66. A trunnion 70 includes an enlarged flange portion 72 and a pivot portion 74 that is mounted within the inner shroud 64. The damper 62 is bonded to the platform 68 and to the trunnion 70. The trunnion 70 is a separate piece from the variable vane body 66. The damper 62 comprises a connecting component that connects the platform 68 to the enlarged flange portion 72 of the trunnion 70. When assembled, the trunnion 70, the platform 68, and the damper 62 rotate together with the variable vane body 66 about the respective vane axis.

In one example, the damper 62 comprises a solid disc that has a radially outer surface 76 and a radially inner surface 78. The radially outer surface 76 is bonded to a generally flat end face of the platform 68 and the radially inner surface 78 is bonded to the generally flat end face of the enlarged flange portion 72 of the trunnion 70.

In one example, the damper 62 is comprised of a resilient or elastomeric material. Examples of such materials are heat cured silicon rubber or room temperature vulcanizing rubber; however, other materials could also be used. The variable vane body 66 is formed from a metallic material such as aluminum, titanium, nickel, steel, etc., for example. The trunnion 70 is comprised of a metal or high temperature plastic. Using a plastic material can reduce wear at the pivot portion 74. The use of the damper 62 provides a heat absorbing component between the radially inner trunnion 70 and variable vane body 66.

Figure 5:
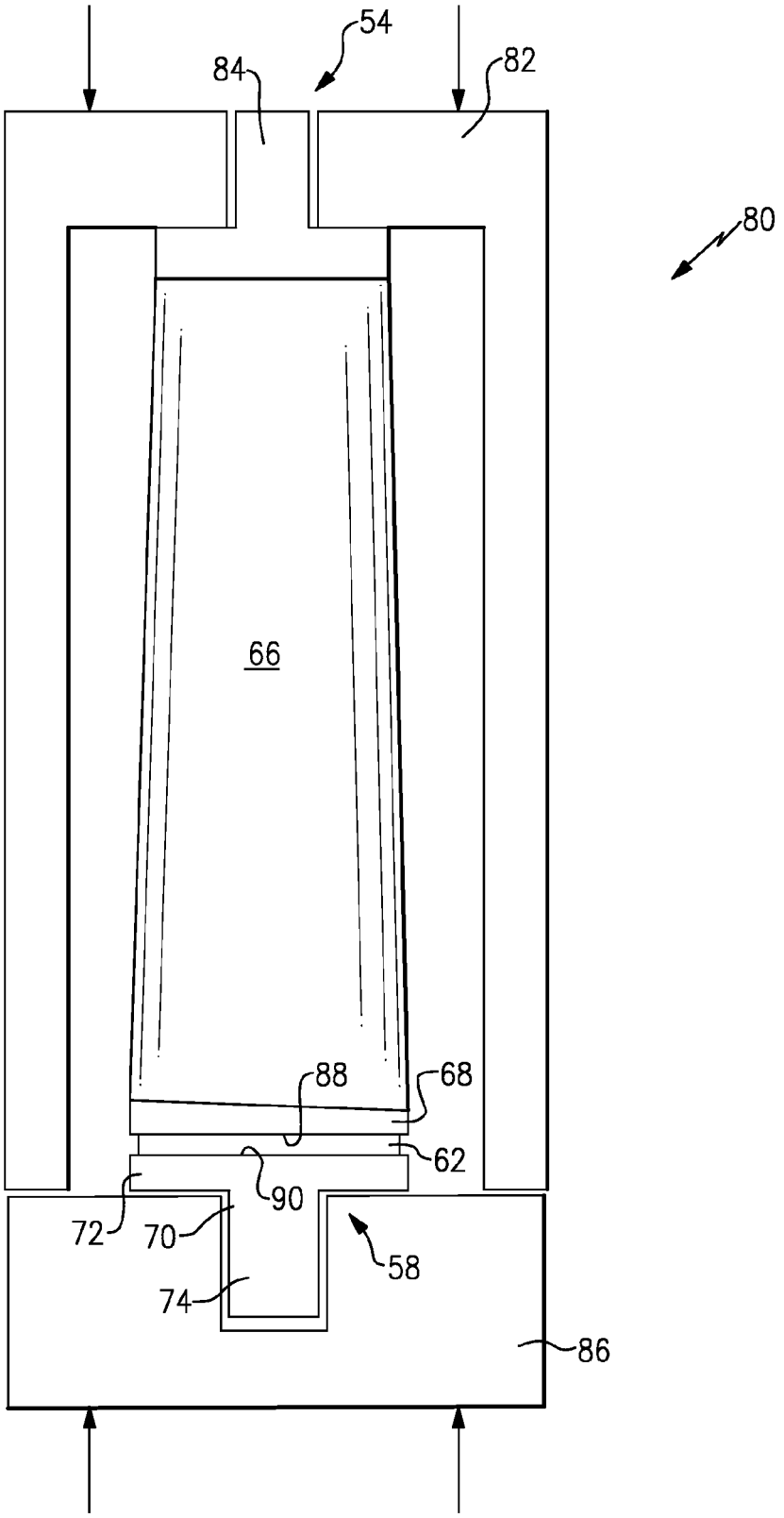
FIG. 5 is a schematic view of a tooling fixture for the variable vane assembly.

As shown in FIG. 5, a tooling fixture assembly 80 is used to form the variable vane assembly 50. One important feature is to provide a consistent overall length of the variable vane assembly 50. Thus, the thickness of the damper 62 must be controlled such that the overall length of the variable vane assembly 50 falls within acceptable tolerance ranges.

The radially outer end 54 of the variable vane body 66 is placed in a first fixture 82, which comprises the outer diameter fixture of the variable vane assembly 50. The radially outer end 54 includes a radially outer pivot portion 84 that is formed as one piece with the variable vane body 66. The vane body 66 is held within the first fixture 82 via the pivot portion 84. In one example, the first fixture 82 comprises a self-centering "chuck."

The pivot portion 74 of the trunnion 70 is placed in a second fixture 86, which comprises the inner diameter fixture for the variable vane assembly 50. In one example, the fixture 86 comprises a block that allows a snug fit for the pivot portion 74. In one example, the fixture 86 is configured to allow for 0.002 inches of concentricity.

The damper 62 is placed between the trunnion 70 and platform 68. The first 82 and second 86 fixtures are squeezed together at a predetermined pressure. The damper material is then cured to bond the damper 62 to the platform 68 and the trunnion 70.

In one example, the damper material is injected as a liquid material between the platform 68 and the trunnion 70. The fixtures 82, 86 are squeezed together to provide a pre-determined thickness for the damper 62. Then the material is cured via a heating process,or by a room temperature cure, until the damper 62 is securely bonded to the platform 68 and trunnion 70.

In another example, a pre-molded disc is placed between the platform 68 and the trunnion 70. Bonding surfaces 88, 90 of the platform 68 and trunnion 70 are prepped for bonding. The surfaces 88, 90 are cleaned and a primer material is applied. In one example, the primer comprises a mild acid that reacts microscopically at the surfaces to increase their roughness. A pre-molded disc is selected and additional liquid damper material is applied on both sides of the disc body. The pre-molded disc can be selected based on disc thickness/height from a plurality of discs. The fixtures 82, 86 are squeezed together until the height dimension is met. Any excess squeezed material is wiped off prior to curing.

In one example, the fixture assembly 80 is configured to hold approximately +/−0.0005 inches tolerance for height yielding and +/−0.002 inches tolerance for a finished part height. Fixture tolerances are approximately +/−0.0005 inches. The finished variable vane assembly 50 can be quickly checked with a go-no-go gauge to verify the overall height.

Although the example variable vane damper 62 is described as located at the radially inner end 58 of the variable vane assembly 50, other examples may include a variable vane damper at the radially outer end 54 of the variable vane assembly 50 instead of, or in addition to, the variable vane damper 62 at the radially inner end 58.

Features of the disclosed example include a variable vane damping assembly that reduces the magnitude of vibratory responses in variable vanes. Geared turbomachines are particularly appropriate for incorporating the disclosed examples due to the relatively low temperatures experienced by variable vanes in the geared turbomachine. Due at least in part to the reduction in vibratory loads experienced by the variable vane, different design options are available to designers of variable vanes.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A variable vane damper, comprising:

a body comprised of a resilient material, the body including a first surface that is bondable to an inner platform of a variable vane and a second surface that is bondable to an inner diameter trunnion component.

2. The variable vane damping assembly of claim 1, wherein the body is comprised of an elastomeric material.

3. The variable vane damping assembly of claim 1, wherein the body is comprised of silicon rubber material.

4. The variable vane damping assembly of claim 1, wherein the body comprises a solid disc-shaped member.

5. The variable vane damping assembly of claim 1, wherein the damper comprises a connecting element that is configured to attach the inner platform to the inner diameter trunnion component to provide the variable vane that is pivotable about a vane axis.

6. The variable vane damping assembly of claim 5, wherein a thickness of the damper is controlled such that an overall length of the variable vane assembly falls within a predetermined tolerance range.

7. A variable vane assembly, comprising:

a variable vane body;

a platform formed at one end of the variable vane body;

a damper bonded to the platform; and a trunnion bonded to the damper.

8. The variable vane assembly of claim 7, wherein the variable vane body has a radially inner end and a radially outer end relative to a central axis of a turbomachine, and wherein the platform is formed at the radially inner end of the variable vane body.

9. The variable vane assembly of claim 8, wherein the damper includes a radially outer surface that is bonded to the platform and a radially inner surface that is bonded to the trunnion.

10. The variable vane assembly of claim 7, wherein the variable vane is positioned within a compression section of a geared turbine engine.

11. The variable vane assembly of claim 7, wherein the trunnion, the platform, and the damper rotate together with the variable vane body.

12. The variable vane assembly of claim 7, wherein the damper is comprised of a resilient material.

13. The variable vane assembly of claim 12, wherein the variable vane body is comprised of a metallic material.

14. The variable vane assembly of claim 13, wherein the trunnion is comprised of a metallic material.

15. The variable vane assembly of claim 13, wherein the trunnion is comprised of a plastic material.

16. The variable vane assembly of claim 7, wherein the variable vane body comprises a separate component from the trunnion, and wherein the damper comprises a connecting element that connects the variable vane body to the trunnion to form a variable vane that is pivotable about a vane axis.

17. The variable vane assembly of claim 16, wherein the trunnion includes an enlarged flange portion and a pivot portion that defines the vane axis, and wherein the damper includes a first surface and second surface opposite the first surface in a direction along the vane axis, and wherein one of the first and second surfaces is bonded directly to an end surface of the enlarged flange portion and the other of the first and second surfaces is bonded directly to an end surface of the platform that faces the end surface of the enlarged flange portion.

18. The variable vane assembly of claim 7, wherein the variable vane body has a radially inner end and a radially outer end relative to a central axis of a turbomachine, and wherein the platform is formed at one of the radially inner and outer ends to provide a first attachment surface, and wherein the trunnion includes an enlarged flange portion and a pivot portion that defines a vane pivot axis, the enlarged portion providing a second attachment surface that faces the first attachment surface, and wherein the damper is bonded directly to the first and second attachment surfaces to connect the variable vane body to the trunnion, and wherein a thickness of the damper is controlled such that an overall length of the variable vane assembly from the radially outer end to the pivot portion falls within a predetermined tolerance range.

19. The variable vane assembly of claim 18, wherein the damper comprises a solid disc-shaped member having first and second opposing mount surfaces in a direction along the vane pivot axis, and wherein the first and second opposing mount surfaces are respectively bonded to the first and second attachment surfaces.

20. A method of assembling a variable vane assembly, comprising:

(a) positioning a variable vane body in a first fixture, the variable vane body including a platform at a radially inner end;

(b) positioning a trunnion in a second fixture;

(c) placing a damper between the trunnion and platform, the damper comprised of an elastomeric material;

(d) squeezing the first and second fixtures together; and (e) curing the elastomeric material to bond the damper to the platform and the trunnion.

21. The method of claim 20, wherein step (c) includes injecting a liquid elastomeric material between the platform and the trunnion.

22. The method of claim 20, wherein step (c) includes positioning a pre-molded disc between the platform and the trunnion.

23. The method of claim 20, wherein the variable vane body comprises a separate piece from the trunnion during steps (a) and (b), and wherein the damper comprises a connecting component that connects the variable vane body to the trunnion during step (e).

24. The method of claim 23, including forming the trunnion to have an enlarged flange portion and a pivot portion, and positioning the damper directly between the platform and the enlarged flange portion.

25. The method of claim 20, including controlling the thickness of the damper such that an overall length of the variable vane assembly falls within a predetermined tolerance range.

26. The method of claim 25, wherein a thickness of the damper is controlled to provide +/−0.002 inches tolerance for a finished part height.

* * * * *